US005797446A

United States Patent [19]

Blomgren

[11] Patent Number: 5,797,446

[45] Date of Patent: Aug. 25, 1998

[54] PLATE HEAT EXCHANGER

[75] Inventor: Ralf Blomgren, Skanör, Sweden

[73] Assignee: Alfa Laval AB, Lund, Sweden

[21] Appl. No.: 737,616

[22] PCT Filed: May 17, 1995

[86] PCT No.: PCT/SE95/00553

§ 371 Date: Nov. 7, 1996

§ 102(e) Date: Nov. 7, 1996

[87] PCT Pub. No.: WO95/31687

PCT Pub. Date: Nov. 23, 1995

[30] Foreign Application Priority Data

May 18, 1994 [SE] Sweden ..... 9401757

[51] Int. Cl.[6] ..... F28D 9/00

[52] U.S. Cl. ..... 165/81; 165/167; 165/DIG. 359

[58] Field of Search ..... 165/81, 166, 167

[56] References Cited

U.S. PATENT DOCUMENTS 4,750,555 6/1988 Ahl et al. ..... 165/166

FOREIGN PATENT DOCUMENTS 98900 5/1940 Sweden .

293491 2/1976 U.S.S.R. .

WO 84/03555 9/1984 WIPO .

*Primary Examiner*—Allen J. Flanigan

*Attorney, Agent, or Firm*—Fish & Richardson P.C.

[57] ABSTRACT

The present invention refers to a plate heat exchanger for heat transfer between two fluids, comprising two frame plates (6) and between these several permanently joined heat transfer plates (3), which have inlet and outlet openings (9) for respective fluids in their corner portions, communicating with connections (8) through at least one of the frame plates (6). The connections (8) are formed of outer extending pipes (10) provided with internal linings (11). The outer pipes (10) are permanently fastened to the frame plate (6) and the internal linings (11) are permanently connected with an adjacent first heat transfer plate (3).

8 Claims, 1 Drawing Sheet

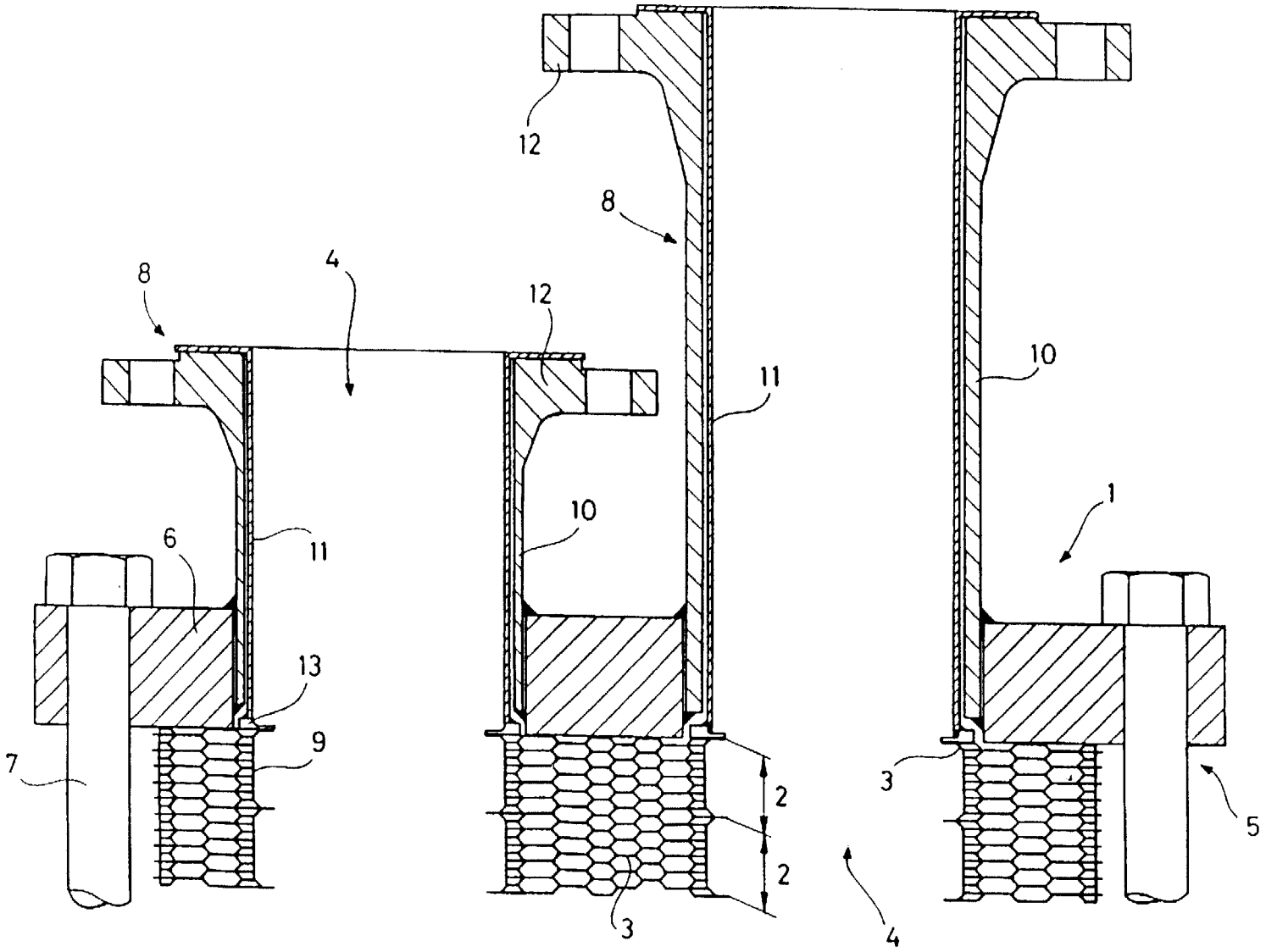
5
1
10
3
4
11
2
2
8
12
12
10
3
4
11
13
9
8
6
7

PLATE HEAT EXCHANGER

The present invention refers to a plate heat exchanger for heat transfer between two fluids, comprising two frame plates and between these several permanently joined heat transfer plates, which have inlet and outlet openings for respective fluids in their corner portions, communicating with connections through at least one of the frame plates.

Permanently joined plate heat exchangers are known for instance by GB 0580368 and GB 2126703. These may be produced in shape of all-welded plate heat exchangers in such a way that the heat transfer plates first are welded together in pairs along an inner line and then two such pairs of plates are welded together along an outer line. An all-welded plate heat exchanger may also be produced in that several heat transfer plates are welded together simultaneously. However, the size of the plate heat exchanger becomes limited to the number of heat transfer plates, which presently may be welded simultaneously.

As an alternative to an all-welded plate heat exchanger, modules composed of 10–20 heat transfer plates may be welded together. After testing the modules they are assembled to a complete plate heat exchanger by means of intermediate gaskets, which admit that the modules may be dismantled from each other and replaced with new in case of a possible defect. Such plate heat exchangers are previously known through SE 304 293 and WO 92/11501. The disadvantage with these is that the intermediate gaskets limit the applicability of the plate heat exchangers.

All-welded plate heat exchangers are used, when the working temperature is high. Therefore, it is essential that the construction admits movements depending on thermic expansion, else very high stresses may arise.

In fast fluctuation of the temperature in the plate heat exchanger, the temperature of the heat transfer plates will follow the temperature of the flowing fluids with a slight delay, while the relatively thick frame plates will have a slower variation of the temperature. This difference between the heat transfer plates and the frame plates lead to a different large expansion.

The heat transfer plates are usually produced of stainless steel, while the frame plates are produced of normal mild steel. The stainless steel has a coefficient of heat expansion, which is about 30% larger than that of the mild steel. This means that the heat transfer plates expand more than the frame plates by a certain raise of temperature.

Thus, the linear expansion will also be larger for the heat transfer plates than for the frame plates at a constant working temperature. Besides, the relative temperature of the frame plates will be lower than that of the heat transfer plates, since the frame plates are cooled by the surroundings.

The difference in prolongation arising between the frame plates and the heat transfer plates cause problems mainly round the inlet and outlet openings. Previously attempt with permanent joining between the internal linings and a first adjacent heat transfer plate has failed, depending on that the material has burst during operation.

One way to avoid this problem is to introduce rubber gaskets between the frame plate and the first adjacent heat transfer plate. This is however undesirable, since the material of the gasket limits the usability of the plate heat exchanger. Another way is to manufacture the frame plates of the same material as the heat transfer plates, which however is excluded for the cause of expense.

The objects of the present invention are to avoid the disadvantages and limitation existing in plate heat exchangers of the known kind and to make a permanent lining of the connections possible without risk of fatigue of the material arising depending on different extension by temperature.

These objects are attained by the present invention, which principally is characterized in that the connections are formed of outer extending pipes provided with internal linings, that the outer pipes are permanently fastened to the frame plate and that the internal linings are permanently connected with an adjacent first heat transfer plate, whereby the internal linings are movable or extendable independently of the outer pipes.

The invention will be described closer in the following with reference to the accompanying drawing, on which FIG. 1 shows a schematic cross-section through a part of a plate heat exchanger according to the invention.

In FIG. 1 a plate heat exchanger 1 for heat transfer between two fluids is shown, comprising several permanently joined modules 2, each consisting of several principally rectangular heat transfer plates 3. The plate heat exchanger 1 has passages 4 for respective fluids. The modules 2 are located in a frame 5, of conventional kind, comprising at least a front end plate 6 and a rear end plate (not shown) and several tightening bolts 7. The front end plate 6 shows connections 8, communicating with the passages 4.

The heat transfer plates 3 are by means of pressing provided with a pattern in shape of ridges and grooves, which ridges of alternating first and second heat transfer plates 3 abut against each other. The heat transfer plates 3 are welded against each other or else permanently joined with each other, for instance through gluing, soldering or a combination of that. The heat transfer plates delimit in every other plate interspace a flow space for the first fluid and in the remaining plate interspaces flow spaces for the second fluid.

The heat transfer plates 3 are elongated and mainly rectangular, although other shapes as round also are possible, and being produced of thin metal plate, which by means of pressing is provided with a conventional corrugation pattern.

The heat transfer plates 3 have inlet and outlet openings 9 located in the corner portions of the heat transfer plates. The inlet and outlet openings 9 for the first fluid are located at a long side of the heat transfer plates and the inlet and outlet openings for the second fluid are located at the other long side of the heat transfer plates, a so-called parallel flow. I.e. When the main flow directions for the fluids, flowing on each sides of the heat transfer plates, intend to be parallel.

The connections 8 is formed of outer extending pipes 10, which are provided with freely fasten internal linings 11. I.e. the internal linings are movable or extendable independently of the outer pipes. The outer pipes 10 are permanently fastened to the frame plate 6 and the internal linings 11 are permanently connected with an adjacent first heat transfer plate 3.

Thus, the outer pipes 10, which are fastened to the end plate 6, follow the expansion of the end plate 6, while the internal linings 11, which are fastened to the heat transfer plate 3, follow the expansion of the heat transfer plates 3.

The outer pipes 10 are suitably provided with flanges 12, to connect the plate heat exchanger with conduits. Also the internal linings 11 can be provided with flanges, which at least partly cover the flanges 12 and protect these. To obtain sufficient length of the internal linings 11, for absorbing movements between the frame plate 6 and the heat transfer plate 3, the flanges 12 ought to be arranged on distance from the frame plate 6. The distance depends on the size of the plate heat exchanger 1, but should be a couple of times larger than the diameter of the pipe 10.

Preferable, the outer pipes 10 are welded to the frame plate 6, but as an alternative they could also be threaded, glued or fasten in any other known manner to the frame plate 6.

On the same way, the internal linings 11 are welded to the adjacent first heat transfer plate 3. To simplify this joining special intermediate spacing rings 13 may be welded firmly between the linings 11 and the first heat transfer plate 3.

To further increase the mobility between the frame plate 6 and the heat transfer plates 3 a slot exists between the internal linings 11 and the outer pipes 10.

The outer pipes 10 are suitably produced of the same material as the frame plate 6 and the internal linings 11 are produced of the same material as the heat transfer plates 3.

I claim:

1. Plate heat exchanger (1) for heat transfer between two fluids, comprising two frame plates (6) and between these several permanently joined heat transfer plates (3), which have inlet and outlet openings (9) for respective fluids in their corner portions, communicating with connections (8) through at least one of the frame plates (6), characterized in that the connections (8) are formed of outer extending pipes (10) provided with internal linings (11), that the outer pipes (10) are permanently fastened to the frame plate (6) and that the internal linings (11) are permanently fastened to an adjacent first heat transfer plate (3), whereby the internal linings (11) are movable or extendable independently of the outer pipes (10).

2. Plate heat exchanger according to claim 1, characterized in that the outer pipes (10) are provided with flanges (12).

3. Plate heat exchanger according to claim 2, characterized in that the flanges (12) are arranged on distance from the frame plate (6).

4. Plate heat exchanger according to claim 1, characterized in that the outer pipes (10) are welded to the frame plate (6).

5. Plate heat exchanger according to claim 1, characterized in that the internal linings (11) are welded to the adjacent first heat transfer plate (3).

6. Plate heat exchanger according to claim 1, characterized in that a slot exists between the internal linings (11) and the outer pipes (10).

7. Plate heat exchanger according to claim 1, characterized in that the outer pipes (10) are produced of the same material as the frame plate (6).

8. Plate heat exchanger according to claim 1, characterized in that the internal linings (11) are produced of the same material as the heat transfer plates (3).

* * * * *